United States Patent [19]

Crump, Jr.

[11] 4,133,056

[45] Jan. 9, 1979

[54] SOILED DIAPER WRINGER DEVICE

[76] Inventor: John M. Crump, Jr., 1018 Parkridge Cir., W., Jacksonville, Fla. 32211

[21] Appl. No.: 790,965

[22] Filed: Apr. 26, 1977

Related U.S. Application Data

[63] Continuation of Ser. No. 618,133, Oct. 23, 1975, abandoned.

[51] Int. Cl.[2] ..... D06F 45/22

[52] U.S. Cl. ..... 4/1; 68/235 D; 68/248

[58] Field of Search ..... 4/1, 142; 15/262; 100/176; 68/235 D, 237–239, 244, 248, 251, 262 A, 273; 403/350–352, 393; 285/178

[56] References Cited

U.S. PATENT DOCUMENTS

| | | | |
|---|---|---|---|
| 378,949 | 3/1888 | Blake | 15/262 |
| 1,110,292 | 9/1914 | Kugel | 68/244 |
| 2,352,845 | 7/1944 | McGowan | 68/235 DX |
| 2,584,709 | 2/1952 | Johnson | 403/393 X |
| 3,142,068 | 7/1964 | Leventhal | 4/1 |
| 3,377,827 | 4/1968 | Drury | 68/248 |
| 3,685,084 | 8/1972 | Bennett | 15/230.11 |
| 3,859,670 | 1/1975 | Crump | 4/1 |

*Primary Examiner*—Stuart S. Levy

*Attorney, Agent, or Firm*—George H. Baldwin; Arthur G. Yeager

[57] ABSTRACT

A device for wringing soiled baby diapers after the diaper has been cleaned of excess soiled materials in the bathroom water closet. This invention consists primarily of two wringer rollers secured to a main attachment frame which can be secured to the conventional standard bathroom water closet seat bolts. When the device is in place below the water closet seat the device does not interfere with customary water closet usage. When it is desired to use the Soiled Diaper Wringer Device the water closet seat and cover are rotated to the usual up position at which time the device is fully exposed for wringing a soiled diaper. This configuration features an outer roller that is mounted to the main attachment frame by a pivot bolt which allows the user to rotate the outer roller outward thereby providing space for diaper insertion. Resilient elastomer bands provide wringer squeezing pressure as the diaper is pulled through the rollers. The invention has the novel features of providing a highly sanitary and hygienic technique for treating soiled baby diapers while at the same time can be installed on existing or new bathroom water closets without interfering with normal customary toilet bowl usage. The unique physical relationship of the two rollers, combined with the pivot action of the other roller, together with single end roller mounting provide for simplicity and ease of installation and operation.

7 Claims, 11 Drawing Figures

SOILED DIAPER WRINGER DEVICE

This is a continuation of application Ser. No. 618,133, filed Oct. 23, 1975; now abandoned.

This invention consists of a device which will wring out a soiled diaper prior to placing the diaper into the used diaper pail. It has the particular objective of providing a highly sanitary and fastidious method of caring for baby diapers.

Existing procedures recommended by the U.S. Department of Health, Education, and Welfare, Children's Bureau Publication Number 8-1963, requires that soiled diapers have the stool emptied into the toilet and the diaper rinsed out prior to adding it to the used diaper pail.

A primary objective of my invention is to provide a device that has the capability of wringing the soiled diapers without having to place the hands onto the diaper in the traditional manner. This will allow a more fastidious procedure and provide a highly sanitary diaper care process.

A further objective is to provide a diaper wringer roller assembly having those physical and geometrical features which will incorporate ease of diaper insertion and will at the same time provide for optimum diaper pull-through wringer squeeze pressure.

A further objective is to provide a diaper wringing device that can be readily installed in existing, as well as new, bathrooms and connected to existing plumbing fixtures without the need for specialized tools and/or equipment.

Manifestly, the Diaper Wringer Device is of such nature that hygenic as well as psychological value, may be derived from the use thereof, and the invention is well adapted to serve as a useful adjunct to the bathroom. Hygenic value is derived from the fact that the hands do not have to make contact with the soiled parts of the diaper. Therefore, the process of using this wringer device provides conditions of cleanliness conducive to the maintenance of health. It is well known that the conventional procedure for treating soiled diapers is extremely repugnant and produces negative psychological reactions. The Soiled Diaper Wringer Device and process of use thereof will eliminate the most repugnant aspect of soiled diaper treatment and thus produce a positive psychological reaction to the accomplishment of this task.

Another objective of this invention is to provide a novel arrangement of rollers together with resilient elastomer bands which will function to wring out the water from the soiled diaper when it is pulled through the rollers.

A further objective is to provide a construction of maximum simplicity, economy, ease of assembly and manipulation, and readily adaptable to the numerous bathroom fixture arrangements. While I have shown and described constructions in which my invention may be embodied, it is to be understood that these constructions have been selected merely for the purpose of illustration and that various changes in the size, shape and arrangement of the parts may be made without departing from the spirit of the invention or the scope of the subjoined claims.

Further objectives appear in the specifications and in the claims. This invention further resides in the construction, combination and arrangement of parts illustrated in the accompanying drawing, and while I have shown therein preferred embodiments, it is to be understood that the same is susceptible to modifications and changes; and comprehends other details, arrangement of parts, features, and constructions without departing from the spirit of the invention, and it is to be understood that all matters herein set forth or shown in the accompanying drawing is to be interpreted as illustrative and not in a limiting sense. In view of this disclosure, variations and modifications will doubtlessly be generated by others skilled in the art to obtain all, or part, of the benefits of this invention without duplicating the framework shown and I therefore claim all insofar as they fall within the reasonable spirit and/or scope of my proposals and claims.

These and other features of the invention will be seen from the following detailed specifications read in connection with the accompanying drawings forming part thereof, and in which.

Figure 3:
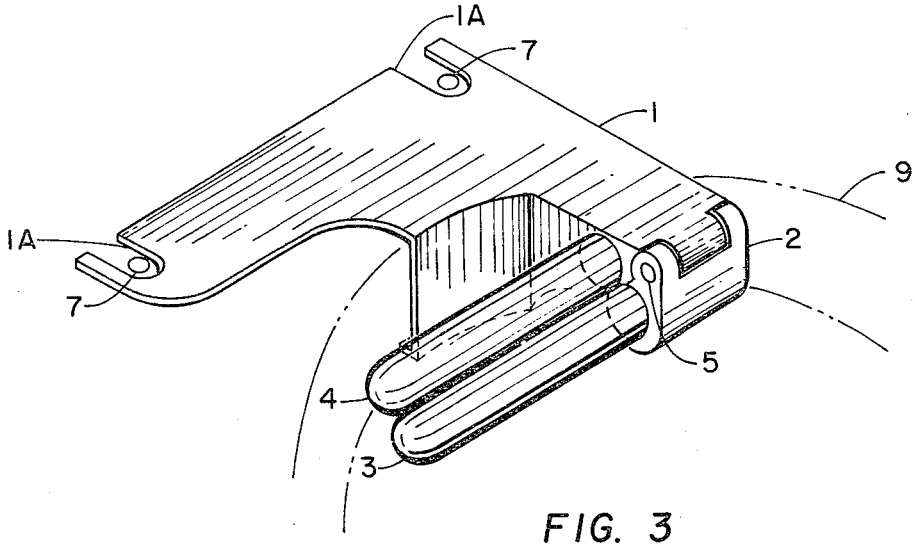
FIG. 3 is a perspective assembly view of one preferred form of the Soiled Diaper Wringer Device mounted on the bathroom water closet illustrating both the technique for attachment to the water closet and the physical relationship of the two wringer rollers.
Figure 4:
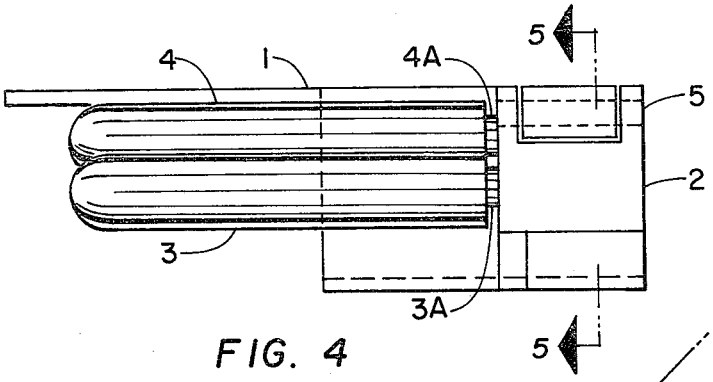
FIG. 4 is a front view illustrating the rollers and their relationship to the main attachment frame.

Referring to the drawings, and more particularly to the form of the invention shown in FIG. 3, it will be seen that the device includes a pair of similar wringer rollers 3 and 4. The rollers may be constructed of plastic with shafts 3A and 4A that project from the main attachment frame and hinged attachment frame 2. The main attachment frame 1 has a pivot bolt 5 which will allow the outer wringer roller 3 to be rotated open thereby providing for initial insertion of the soiled diaper between the two wringer rollers. Integral with the main attachment frames are attachment bosses 6A and 6B onto which the resilient elastomer band is mounted.

Figure 1:
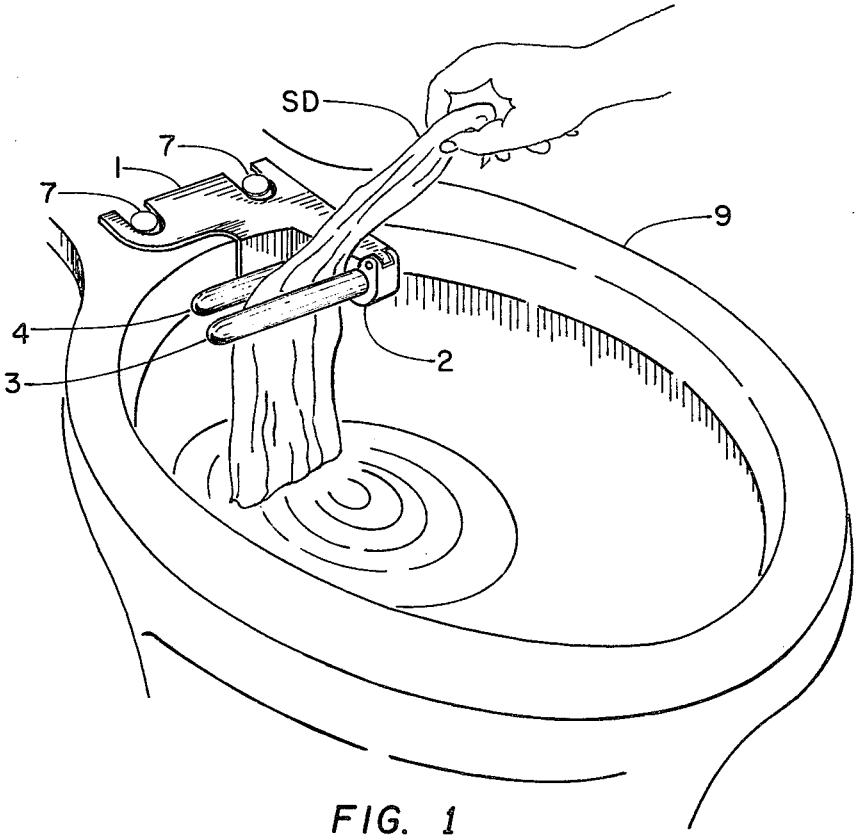
FIG. 1 is a perspective view of one preferred form of the Soiled Diaper Device showing all members in their general relationship to one another and illustrates an arrangement which allows the outer roller to be rotated to the open position thereby providing for easy diaper insertion and easy process of use.

The main attachment frame 1 is attached to the water closet 9 by loosening nuts 7A and inserting slots 1A around bolts 7 after which nuts 7A are tightened. Resilient elastomer band 6 has two circular openings which fit over attachment bosses 6A and 6B. Band 6 holds the two rollers 3 and 4 together under pressure. When hinged attachment frame 2 is pulled at point 8A band 6 is stretched due to roller 3 pivot action outward about pivot bolt 5. This provides a gap between the rollers 3 and 4 through which the soiled diaper SD may be inserted up in between the rollers 3 and 4. Once the end of soiled diaper SD is inserted between rollers 3 and 4 hinged attachment frame 2 can be released thereby allowing the resilient elastomer bands 6 to apply a squeezing pressure to wringer rollers 3 and 4. As shown in FIG. 1 the soiled diaper SD is grasped with the fingers by the clean dry end and pulled through the rollers 3 and 4. The excess water is thereby removed and the diaper SD may be placed in the diaper pail. The water closet seat 10 may be placed in the down position for normal usage. The Soiled Diaper Wringer Device remains in place and can be constructed to such physical dimensions that it will fit between the inner rim 9A of the water closet 9 and the curved edge 10A of seat 10. Therefore, due to the unique mounting locaton of this invention it becomes a permanent part of the water closet and does not interfere with customary water closet usage. The device may be removed when the owner no longer has soiled diapers to wash.

Referring to FIG. 3, it will be seen that the device includes wringer roller 3 attached at one end only to main attachment frame 1 and wringer roller 4 attached at one end onto hinged attachment frame 2. In lieu of inserting the soiled diaper from the bottom as required by rollers supported at both ends this form shown in FIG. 3 will allow the diaper to be inserted from the side. The basic function of the hinged attachment frame 2 is to allow the outer roller 3 to be rotated outward and away from roller 4. This invention is employed for wringing out soiled diapers after the diaper has been cleaned of all loose material in the water closet bowl.

Figure 2:
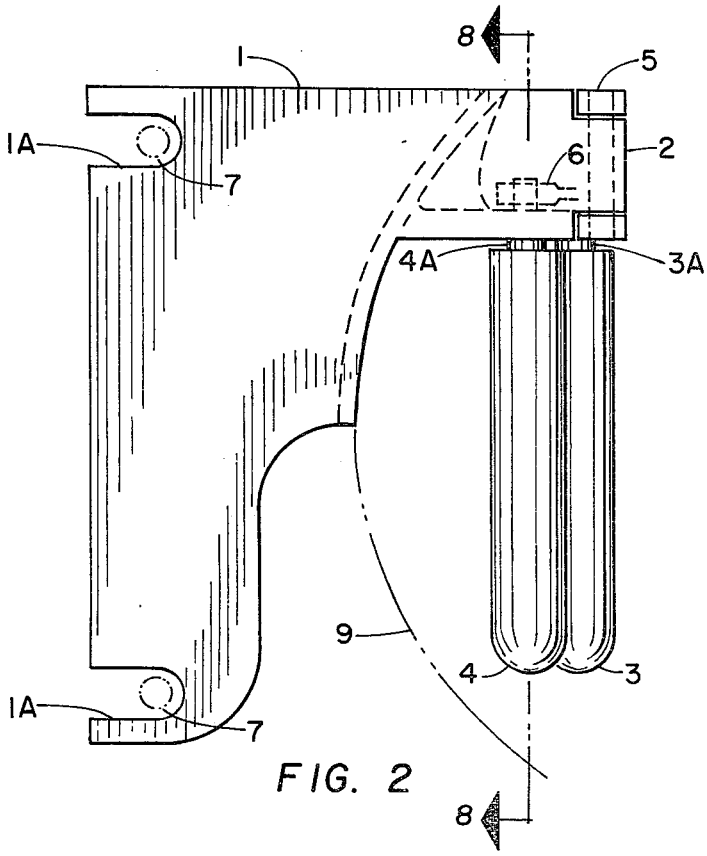
FIG. 2 is a plan view showing the main attachment frame, wringer rollers and outer roller pivot bolt hinged to the main attachment frame.
Figure 6:
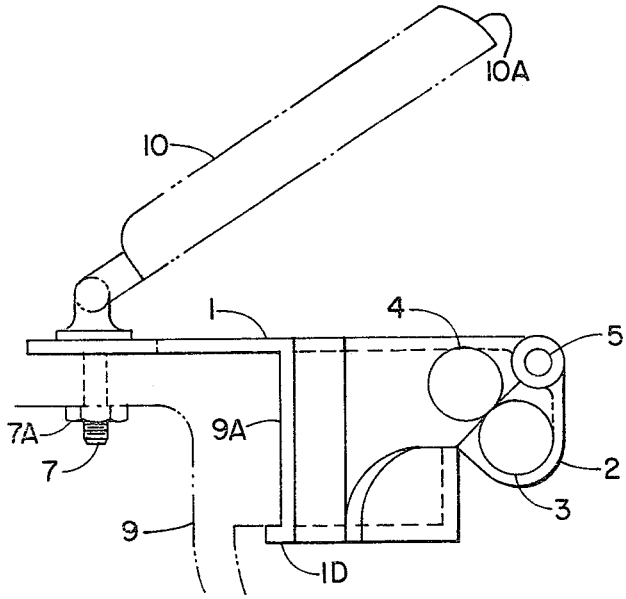
FIG. 6 is an end view showing a form for attaching the wringer rollers to the main mounting attachment frame and their relationship to the water closet.

As illustrated in FIGS. 2, 3, and 6 one wringer roller 4 is attached to the main attachment frame 1 which is mounted to water closet 9. Roller 4 is restrained from any motion other than turning on its shaft 4A due to main attachment frame 1 being fixed to water closet 9. Pivot bolt 5 is round in cross section thereby providing a hinge connection between main attachment frame 1 and hinged attachment frame 2.

In this construction wringer roller 3 and hinged attachment frame 2 can rotate about pivot bolt 5 whereas wringer roller 4 is fixed from translation due to main attachment frame 1. Hinged attachment frame 2 together with its wringer roller 3 may be rotated to an open position by applying pull pressure with the fingers to point 8A in the clockwise direction as viewed in FIG. 5.

Figure 5:
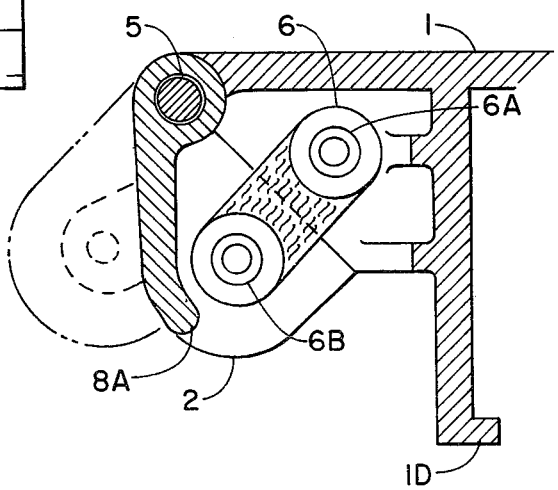
FIG. 5 is a partial sectional view showing the resilient pressure element, roller shafts and pivot action to rotate the outer roller away from the inner roller.

Observe in FIGS. 5 and 6 that when hinged attachment frame 2 is rotated to the clockwise position as allowed by resilient elastomer band 6 the wringer rollers are separated, the soiled diaper may be initially inserted in between the two wringer rollers 3 and 4 at which time hinged attachment frame 2 is released allowing wringer roller 3 to rotate into the closed position. Rotational resistance and wringer squeezing pressure is due to the resilient elastomer band 6 which is connected between attachment bosses 6A and 6B as shown in FIG. 5. Referring to FIG. 1 the soiled diaper is grasped by the clean dry end and pulled through wringer rollers 3 and 4. The excess water is thereby removed and the diaper may be placed into the diaper pail. The device is mounted on the water closet by means of slots 1A and the device is so located that the device does not interfere with normal customary water closet usage.

Figure 9:
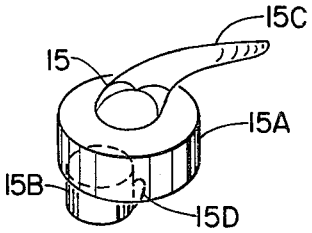
FIG. 9 is a view in perspective of the eccentric shaft locking button.
Figure 7:
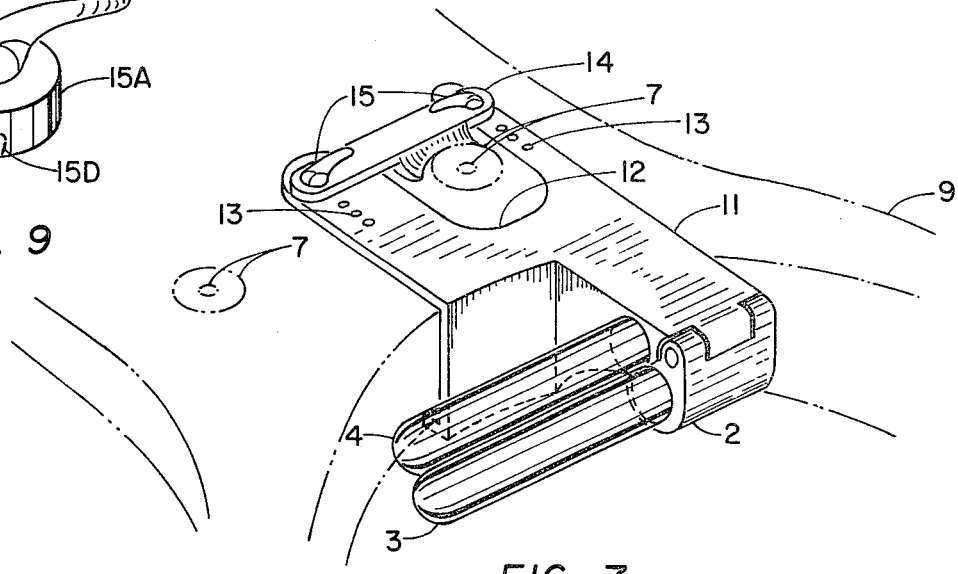
FIG. 7 is a perspective view illustrating a second form of the Soiled Diaper Wringer Device for attachment to bathroom water closet seat bolt.
Figure 8:
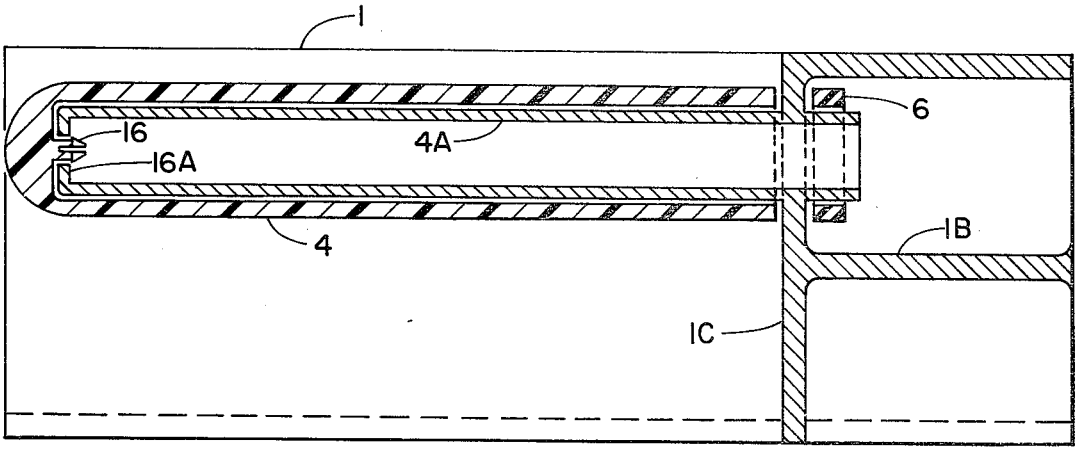
FIG. 8 is a sectional view in the side elevation of the form shown in FIG. 2; taken along Line 8—8 of FIG. 2.
Figure 10:
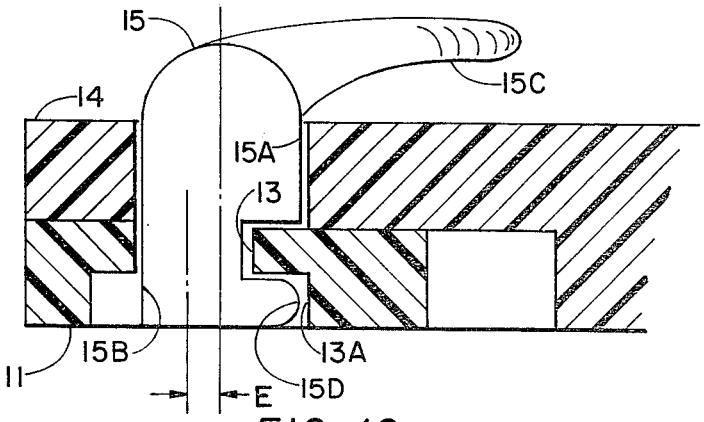
FIG. 10 is a sectional view in side elevational form of the anchor bar and mounting frame.
Figure 11:
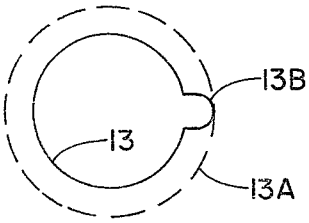
FIG. 11 is a bottom view of the recess in the mounting frame of FIG. 10.

Referring to FIGS. 8 and 9 and more particularly to the modified form of the invention as depicted in FIG. 7, it will be seen that the device includes an adjustable anchor bar 14 that spans across the open end of slot 12. The modified form shown in FIG. 7 provides a main mounting frame 11 having a slot 12 which, when adjustable anchor bar 14 is removed, will allow main mounting frame 11 to be installed around toilet seat bolt 7. The basic function of the adjustable anchor bar 14 in combination with eccentric shaft locking buttons 15 and receiving apertures 13 is to provide an alternate installation means having sufficient adjustment to accommodate variations in water closet seat bolt locations. By providing two rows of receiving apertures 13 the adjustable anchor bar can be so positioned into the proper receiving aperture 13 that the combined adjustment capability of eccentric shaft locking buttons 15 will allow the installer to apply a force between anchor bar 14 and seat bolt 7. Also observe that it is not necessary to remove bolt 7 to install the soiled diaper wringer device. Observe in FIG. 9 that eccentric shaft locking button 15 comprises an integral assembly having four identifiable parts. Shaft 15B is smaller in diameter than shaft 15A and located on a vertical centerline which is offset from the vertical centerline of shaft 15A an amount equal to E. Close tolerance fit between shaft 15A and receiving apertures 13 provides sufficient retention force to hold eccentric shaft locking button 15 onto adjustable anchor bar 14 and main attachment frame 11. To assure positive retention of adjustable anchor bar 14 a knob 15D is provided. Refering to FIG. 10 it will be seen that knob 15D is retained by recess 13A. FIG. 11 shows slot 13B through which knob 15D passes when eccentric locking button 15 is inserted during installation.

As illustrated in FIG. 8, wringer roller 4 is attached to wringer roller shaft 4A which is integral with main attachment frame 1. The closed end of wringer roller 4 has a split rivet snap in fastener 16 located on the inside and integral with wringer roller 4. Wringer roller 4 is fastened to wringer roller shaft 4A by inserting wringer roller 4 over wringer roller shaft 4A until split rivet 16 snaps into receiving aperture 16A located in the end of wringer roller shaft 4A. Once the wringer roller 4 is in place on wringer roller shaft 4A it is free to turn around wringer roller shaft 4A as soiled diaper SD is pulled between wringer roller 3 and wringer roller 4. Observe that the above described features in wringer roller 4 apply equally to wringer roller 3 and furthermore that these features apply equally to main attachment frame 11 as shown in FIG. 7. Referring to FIG. 8 observe that the main attachment frame 1 is strengthened by reinforcing fin 1B communicating between the main attachment frame 1 and the vertical face 1C. Having thus shown and described the several embodiments of the invention, it is to be understood that obvious variations can be made. Variations, therefore, in the construction and arrangement may be made without departing from the spirit and scope of the invention as disclosed in the appended claims, in which it is intended to claim all novelty inherent in the invention as broadly as permissible, in view of prior art.

While I have shown and described constructions in which my invention may be embodied, it is to be understood that these constructions have been selected merely for the purpose of illustration and that various changes in size, shape and arrangement of the parts may be made without departing from the spirit of the invention or the scope of the subjoined claims.

Having thus described my invention I claim as new and desire to secure by Letter Patent:

1. In combination a wringer attachable to and disposable in a water closet and having a main mounting frame including a generally horizontal portion and a generally vertical portion, means for attaching said frame to a water closet bowl, a first elongated wringer element adjacent said vertical portion and having a longitudinal axis extending generally horizontally between one end and an opposite end which is mounted to said frame and disposable substantially beneath the rear portion of a water closet seat, a second elongated wringer element spaced from said vertical portion and having a longitudinal axis extending between one end and an opposite end and being parallel to said first element, the improvement comprising an auxiliary mounting frame, hinge means having an axis for mounting said auxiliary frame to said horizontal portion of said main frame inwardly of a water closet bowl, attachment means for connecting said opposite end of said second element to said auxiliary frame, said hinge axis and each of said longitudinal axes of said elements being spaced apart and parallel, said second element having its axis spaced below said axis of said first element to dispose said second element in an offset position with respect to said first element whereby said second element is located inwardly of a water closet bowl and substantially beneath the curved edge of a rear portion of a water closet seat, said hinge axis being located remotely above said axis of said second element and generally above said axis of said first element, said hinge axis being disposed offset from a plane defined between and including said longitudinal axes and spacedly away from the periphery of each of said elements whereby pivoting of said auxiliary frame and its attached said second element about said hinge axis moves said second element laterally of and generally upwardly away from said first element to define a generally uniform space between said elements for the ready longitudinal insertion of material to be wrung between said one end of said elements, and resilient means biasing said second element toward said first element for wringing out material therebetween.

2. The combination as defined in claim 1 wherein each said element is a cylindrical roller having a closed hemispherical free end with each roller being rotatably mounted on respective said frames.

3. The combination as defined in claim 1 wherein said hinge axis is located generally midway of said axes of said elements.

4. The combination as defined in claim 1 wherein said hinge axis is located generally equidistance of said axes of said elements.

5. The combination as defined in claim 1 wherein said auxiliary frame includes a hand engageable means for applying a force thereto in a direction generally opposite to the direction of biasing by said resilient means thereby to temporarily separate said elements.

6. The combination as defined in claim 1 wherein said resilient means includes a resilient band surrounding both of said wringer elements adjacent said opposite ends thereof.

7. The combination as defined in claim 1 wherein said horizontal portion of said main frame includes a pair of arms disposable on either side of one water closet seat mounting bolt, and mounting means locatable rearwardly of a water closet seat mounting bolt and adjustably supported along said arms for connecting said wringer to only one water closet seat mounting bolt.

* * * * *